US005292159A

United States Patent [19]

Sandhu et al.

[11] Patent Number: 5,292,159

[45] Date of Patent: Mar. 8, 1994

[54] LATCH MECHANISM FOR VEHICLE GLOVE BOXES OR THE LIKE

[75] Inventors: Chain S. Sandhu, Farmington Hills; Lev Lilov, Southfield, both of Mich.

[73] Assignee: NYX, Inc., Redford, Mich.

[21] Appl. No.: 36,629

[22] Filed: Mar. 24, 1993

[51] Int. Cl.[5] ..... E05C 5/00

[52] U.S. Cl. ..... 292/173; 292/DIG. 38; 292/DIG. 31

[58] Field of Search ..... 292/173, 161, 143, DIG. 31, 292/DIG. 38, DIG. 64, DIG. 65

[56] References Cited

U.S. PATENT DOCUMENTS

| | | | |
|---|---|---|---|
| 3,871,198 | 3/1975 | Miller | 292/173 X |
| 4,023,840 | 5/1977 | Souza et al. | 292/DIG. 38 X |
| 4,116,027 | 9/1978 | Tannery | 292/173 X |
| 4,580,822 | 4/1986 | Fukumoto | 292/DIG. 64 X |
| 4,882,919 | 11/1989 | Craig | 292/DIG. 31 X |
| 5,098,141 | 3/1992 | Bull | 292/252 |

*Primary Examiner*—Richard E. Moore
*Attorney, Agent, or Firm*—Dinnin & Dunn

[57] ABSTRACT

A new latch mechanism for a vehicle glove box doors, or other locking requirements, wherein the door is to be held in flush position relative to an adjoining panel surface, said latch mechanism comprising, an injection molded plastic body, an injection molded plastic handle, an injection molded lock member or actuator member, with the previous parts being spring biased into their appropriate positions during operation of the latch mechanism, and with the actuator member being of sufficient width to provide a strong retaining force for the latch mechanism upon the event of a vehicle crash impact and also acting to provide a wide contact locking surface to thereby assist in preventing flex distortions between said door and panel surface.

15 Claims, 1 Drawing Sheet

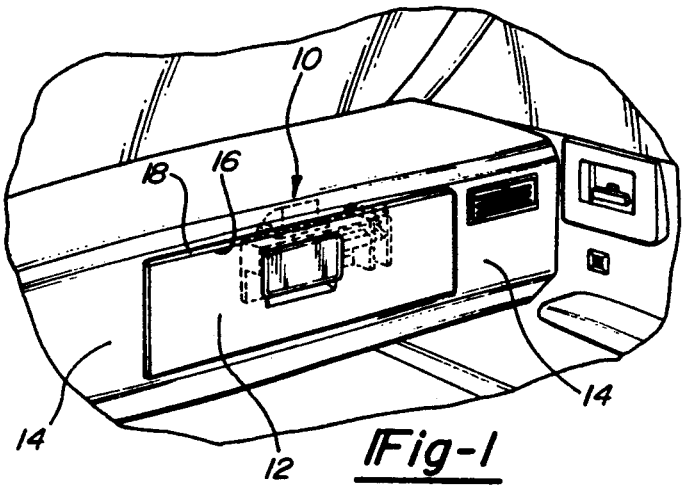
Fig-1
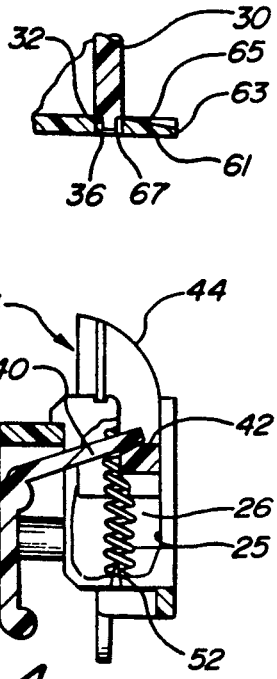
Fig-4
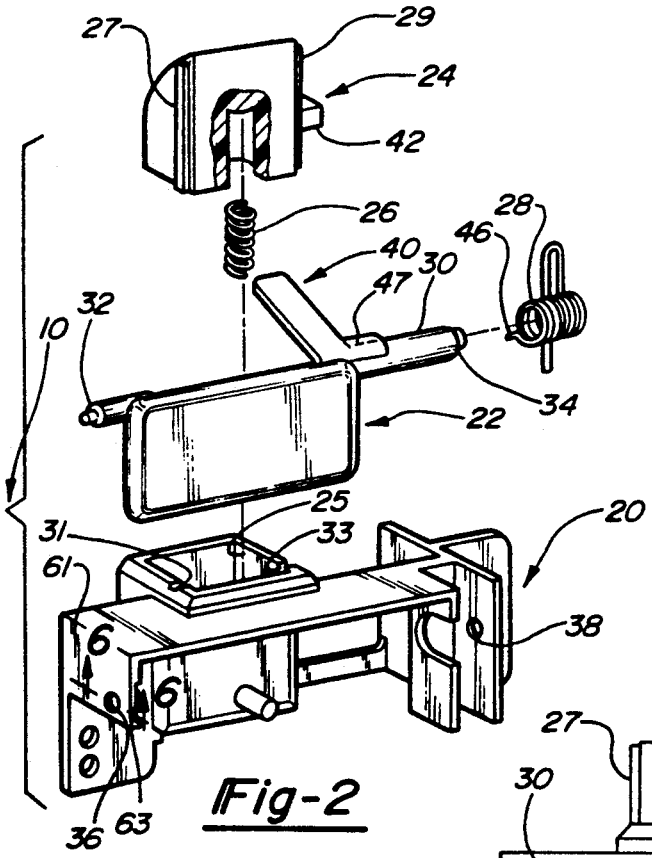
Fig-2
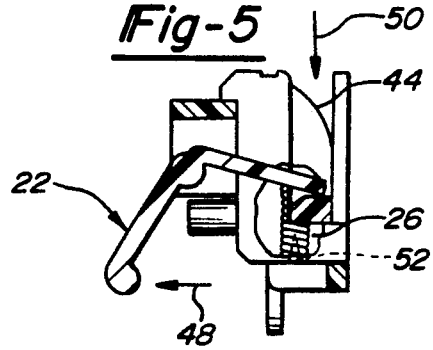
Fig-5
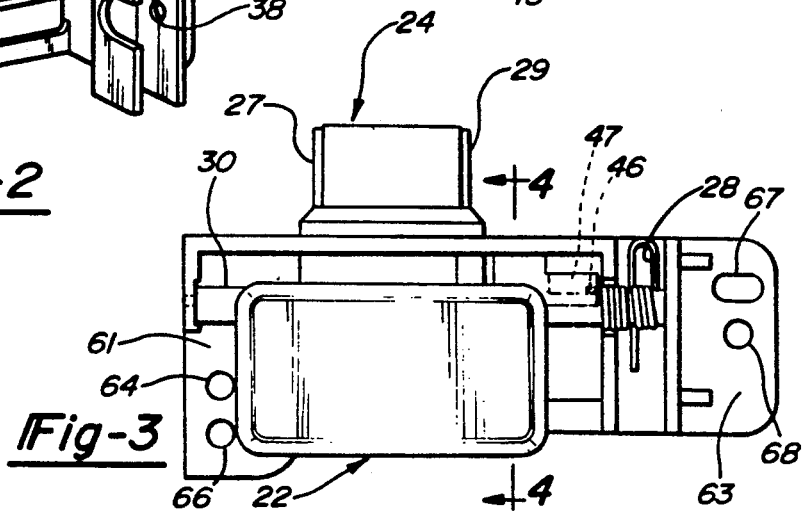
Fig-3
Fig-6

LATCH MECHANISM FOR VEHICLE GLOVE BOXES OR THE LIKE

BACKGROUND OF THE INVENTION

This invention broadly relates to a new latch mechanism. More particularly the invention relates to a novel and improved latch mechanism which possesses advantages in safety, economics of production, and excellent operational features.

Over the last several years, in the art of glove box latching mechanisms, there has been a need for a technically advanced latching mechanism which possesses good safety characteristics, and which would also be economical to produce and possess excellent operative features. Previous latch mechanisms of this general type have been unsatisfactory in that the prior mechanisms were expensive to produce, and also they did not function properly to assist in preventing distortions from occurring when the glove box door was placed in its closed position relative to a housing surface which received the door. Such distortions would occur through flexing and/or movement of the curved housing surface relative to the door. While attempts have been made in the past to solve such problems, previous latching mechanisms were either too costly, did not operate satisfactorily, and/or were ineffective in assisting the mating surfaces to be properly aligned.

The state of the art is indicated by the following cited references, U.S. Pat. Nos. Pelcin No. 2,600,483; Colonna No. 2,642,300; Balogh No. 2,871,048; Doerrfeld No. 3,782,141, Hieronymi et al. No. 4,420,954; and Sato et al. No. 4,480,404.

Accordingly a primary object of the invention is to provide a new latch mechanism which is economical to produce and which possesses improved safety and operational features.

Another object of the invention is to provide a novel glove box latch mechanism possessing a centrally located actuator member, which depresses to lock or unlock the mechanism, and which also includes a wide locking feature to provide advantages in both safety and operational usage.

Another object of the present invention is to provide a new glove box latch mechanism which functions to assist in preventing distortions between the glove box door and a housing surface which receives the door when the latch mechanism is in a closed locked position.

Other objects, features and advantages of the present invention will become apparent from the subsequent description and the appended claims taken in conjunction with the accompanying drawings.

BRIEF DESCRIPTION OF THE DRAWINGS

FIG. 1 is an overall view of a glove box door in which the latch mechanism of the present invention is mounted;

FIG. 2 is an exploded view of the latch mechanism illustrated in FIG. 1;

FIG. 3 is a front view of the latch mechanism shown in FIG. 1 or FIG. 2;

FIG. 4 is a cross-sectional view taken along the line 4—4 in FIG. 3;

FIG. 5 illustrates the same sectional view as shown in FIG. 4, except that the door handle is pulled to show the lock or actuator member in depressed position; and FIG. 6 illustrates a sectional view taken along the line 6—6 in FIG. 2.

SUMMARY OF THE INVENTION

Briefly stated, the present invention involves a latch mechanism for a vehicle glove box door, or other locking requirements, wherein a door is to be held in flush position relative to an adjoining panel surface, said latch mechanism comprising, (i) first means to provide a housing for the mechanism, (ii) a second means which operates as a handle and is pivotable on an axis to thereby provide an ability to unlock the latch mechanism, with the second means being spring biased to a generally flush position relative to the door and panel surface, (iii) a third actuator means which is moveable between at least first and second positions to lock and unlock the latch mechanism, and said actuator means including a spring member which biases the actuator means into a locked position, said actuator means being of sufficient width to provide a strong retaining force for the latch mechanism upon the event of a vehicle crash impact and also to provide a wide contact locking surface to thereby assist in preventing flex distortions between said door and panel surface.

BEST MODE OF CARRYING OUT THE INVENTION AND DESCRIPTION OF PREFERRED EMBODIMENTS

Referring now to the drawings, wherein like numerals indicate like elements, the latch mechanism designated 10 in FIG. 1 acts to releasably lock the glove box door 12 in a position generally flush with the surrounding panel surface 14 such that the edge 16 of the door 12 is in flush smooth mating relationship with the door jam 18 and surrounding surface 14.

As shown in FIGS. 2-5 the latch mechanism 10 is comprised of a body or housing 20, a pivotable handle member 22, and a locking member or actuator member 24. The actuator member 24 is spring biased to an upward position by the spring 26 and the handle member 22 is biased by spring 28 to a flush position with the front of the body member 20 and the glove box door 12.

The handle member 22 is pivotable on the axle member 30 which has opposed ends 32 and 34. The ends 32 and 34 fit within the receptive apertures 36 and 38 (best seen in FIG. 2). The handle member 22 also includes the lever arm 40 which co-acts on the shoulder member 42 of the actuator 24, such that when the handle 22 is pulled outwardly it acts to depress the shoulder 42, which in turn depresses the lock or actuator member 24 and releases the glove box door for opening. As will be seen from the drawings (e.g. FIG. 2), the actuator member 24 is slidably mounted within the receptacle area 25, and the actuator 24 is guided up and down therein by the rail members 27, 29 which fit within their respective slide channels 31, 33.

A camming surface 44 is positioned on the rear side of the lock or the actuator member 24, such that when the glove box door is closed the camming surface 44 acts to depress the actuator member past the stop member or door jam, and once past, the actuator member 24 then resumes its fully extended position due to the upward action of the biasing spring 26, thereby locking the glove box door in position until further entry is sought by the user.

As best seen in FIG. 3, the handle 22 is biased by the spring 28 to a closed position which is flush with the exterior surface of the glove box. The spring 28 has a spring-loading arm member 46 which is held in spring tension against the stop portion 47 on the rear side of the axle member 30. Thus, as shown in FIG. 3 or FIG. 5, when the handle 22 is pulled in the outward direction shown by the arrow 48 the handle is biased by the spring 28 (such that it will seek to return to its flush position); and the arm 40 depresses the actuator member 24 in the direction shown by the arrow 50. The actuator member 24 itself is biased by the spring 26 such that it continually favors being returned to its original upright position as shown in FIG. 4. The spring 26 is conveniently held in position at its lower end by the locator stump member 52.

As will be seen from the drawings (FIGS. 4 and 5), usage of the two springs 26 and 28 in the arrangement shown permits the actuator member 24 to be automatically depressed upon re-closing of the glove box door due to the action of the cam surface 44. When such automatic depression occurs the handle member 22 will stay in its position as shown in FIG. 4 due to the free movement of the actuator member 24 downwardly within its receptacle 25. The handle 22 remains in the position shown in FIG. 4 when this occurs due to the biasing action of the spring 28. As will also be appreciated from this invention, the latch mechanism 10 could be made with only a single spring 26; however, in such situation there would normally be a small amount of free float on the handle member 22 when the actuator member. Thus it is preferable to include the usage of two spring members.

The housing 20 also includes mounting flange members 61 and 63. These flange members contain one or more mounting apertures such as those designated 64, 66 at the left hand end, and mounting apertures 67, 68 at the right hand end of the housing 20. These mounting apertures are used for the purpose of receiving small fasteners or screws which mount the latch mechanism and its corresponding housing into a receptacle area (not shown) within the glove box door.

FIG. 6 illustrates another special feature of the invention. In FIG. 6 the end 32 of the axle member 30 is positioned within the aperture 36 to prevent rotation of the handle 22. In addition, it is seen in FIG. 6 that original positioning of the axle end 32 into the aperture 36 is facilitated due to an upwardly sloped surface 65 which is molded into the wall 61, such that when the axle end portion 32 is initially assembled to the body housing 20, the sloped surface 67 on the end 32 of the axle member rides up the surface 65 until it seats within the aperture 36. This feature significantly facilitates the assembly of the handle and axle member within the housing 20 and once assembled the pressurized fit of the axle end portion 32 within the aperture 36 gives a firm tight-fitting engagement, and yet it also provides an engagement such that the axle member 30 can be readily pivoted due to its mounting within the right and left end apertures 36, 38.

Technical advantages of the invention:

1) The materials used in constructing the new latch mechanism of this invention are preferably as follows. The body housing 20 is preferably formed of a 30% glass reinforced plastic material (such as for example Rynite TM ). The handle member 22 is also preferably formed of a 30% glass reinforced molded plastic (such as for example Nylon). Broadly stated however, it should be understood that the percent of glass reinforcement, in either the housing 20 or the handle 22, can be within the range of about 15% to about 40% by weight. The actuator member 24 is preferably formed of an injection molded plastic material (such as for example Delrin). It has been found that, using the materials referred to above, the latching mechanism as described in this invention works and operates extremely well after 20,000 cycles at 10 seconds per cycle, whereas industry requirements are only in the range of 5,000 cycles. Frictional heat causes no problems during this number of 20,000 cycles, and the completely plastic assembly provides a very lightweight latching mechanism which has been found to be very stable and safe under simulated vehicle crash conditions.

2) From an inventive engineering concept point-of-view the latch mechanism of this invention is made with a very low number of components (i.e. there are only 3 plastic parts and the described spring means). As referred to herein, from a safety aspect, the latch mechanism can withstand impact and separation forces under virtually all vehicle crash conditions wherein the actuator movement provided still provides a secure locking arrangement. In addition, as shown in this invention, the actuator member 24 is of a significant width dimension and it is suitably located generally in the center of the latch mechanism. The cross pivot-axle member 30, once assembled and located within its position, is very difficult to remove and yet it requires no added or special fasteners. In addition, as described herein, the latch mechanism can be made, if desired, with only a single spring member of the type shown at element 26. The significantly wide actuator member 26 provides more retaining force under vehicle crash conditions and it also provides a wider contact surface, which thereby prevents flex and/or distortion from occurring between the glove box door and the surrounding panel surface, which in previous latching mechanisms of this type (particularly in curved vehicle glove box configurations) led to unsightly distortions and/or gaps and spaces between the glove box door and adjoining panel surface. Still further, in that the main components of the latch mechanism are made of injection molded plastic, this enables color matching (through the use of appropriate color dyes in the plastic molding material) for auto interiors without the necessity of any painting of the latch mechanism. The mounting flanges shown at elements 61 and 63 are also highly advantageous in that these flanges permit the adaptation and mounting of this latch mechanism in virtually any design requirement, while still providing a very low profile which is a very important feature required for latch mechanisms of this type in the automotive field.

3) Due to the low number of moveable plastic parts required for the latch mechanism, it has been found that the mechanism as described can be made at very economical costs, while still being highly efficient under actual operating conditions. Still further, due to the low number of parts involved and the simple spring means used, the latch mechanism is extremely easy to assemble while at the same time it is considered to be the most efficient, stable, safe, low cost latch mechanism in the automotive field.

While it will be apparent that the preferred embodiments of the invention disclosed are well calculated to fulfill the objects, benefits, and advantages of the invention, it will be appreciated that the invention is susceptible to modification, variation, and change without departing from the proper scope or fair meaning of the subjoined claims.

What is claimed is:

1. A latch mechanism for securing a door in flush position relative to an adjoining panel surface, said latch mechanism comprising, (i) first means to provide a housing for the mechanism, (ii) a second means which operates as a handle, said handle integral with and pivotable on an axle member, for unlocking the latch mechanism, with the second means being spring biased to a generally flush position relative to the door and panel surface, (iii) a third actuator means centrally located with respect to said handle, which is movable between at least first and second positions to lock and unlock the latch mechanism, and said actuator means including a spring member which biases the actuator means into a locked position, said actuator means being of sufficient width to provide a strong retaining force for the latch mechanism upon the event of a vehicle crash impact and also to provide a wide contact locking surface to thereby assist in preventing flex distortions between said door and panel surface.

2. The invention of claim 1 wherein, said mechanism consists of no more than three plastic parts, and helically formed spring member to bias the latch mechanism into its locking position.

3. The invention of claim 1 wherein, said actuator means has a sloped surface on one side thereof which acts to cam the actuator means to a depressed position upon closing of the door, and said actuator means is generally centrally located relative to the width of the housing.

4. The invention of claim 3 wherein, said first and second means are made of a glass filled plastic, and the actuator means is made of a strong smooth low friction plastic, to thereby provide a latch mechanism which is very light weight, stable, and safe under crash conditions.

5. The invention of claim 1 wherein, said mechanism consists of no more than three plastic parts, and helically formed spring member to bias the latch mechanism into its locking position, said actuator means has a sloped surface on one side thereof which acts to cam the actuator means to a depressed position upon closing of the door, and said actuator means is generally centrally located relative to the width of the housing.

6. The invention of claim 5 wherein, said first and second means are made of a glass filled plastic, and the actuator means is made of a strong smooth low friction plastic, to thereby provide a latch mechanism which is very light weight, stable, and safe under crash conditions.

7. The invention of claim 1 wherein, said second means has a traverse axle member with opposite ends thereof mounted in receptive apertures of the housing, said actuator means being generally centrally located relative to said transverse axle member.

8. The invention of claim 7 wherein, said mechanism consists of no more than three plastic parts, and helically formed spring member to bias the latch mechanism into its locking position.

9. The invention of claim 8 wherein, said first and second means are made of a glass filled plastic, and the actuator means is made of a strong smooth low friction plastic, to thereby provide a latch mechanism which is very light weight, stable, and safe under crash conditions.

10. The invention of claim 9 wherein, said housing has flange members at each end thereof, with at least two apertures in each flange to thereby facilitate mounting of the latch mechanism.

11. A latch mechanism for securing a vehicle glove box door in a flush position relative to an adjoining panel surface, said latch mechanism comprising:

a box-like housing have a plurality of mounting flanges attached thereto, said mounting flanges positioned such that they may be placed adjacent said door for use in securing said box-like housing to said door, said housing further including a channel disposed therein;

a latch slidably disposed within said housing, said latch including a transversely extending rail member which is slidably disposed in said channel, said latch member further including an outwardly extending shoulder portion;

a handle pivotally mounted on said housing, said handle including an axle member integral with said handle and further including a lever arm extending radially outward from said axle member;

a spring disposed about said axle member and acting to rotate said axle member such that said handle is urged inward towards said door surface; and a spring member disposed between said housing and said latch member operative to urge said latch member outward into a latch position.

12. A latch mechanism for securing a vehicle glove box door in a flush position relative to an adjoining panel surface, said latch mechanism comprising:

a box-like housing have a plurality of mounting flanges attached thereto, said mounting flanges positioned such that they may be placed adjacent said door for use in securing said box-like housing to said door, said housing further including a channel disposed therein and a slot in a sidewall of said housing;

a latch slidably disposed within said housing, said latch including a transversely extending rail member which is slidably disposed in said channel, said latch member further including an outwardly extending shoulder portion said shoulder portion extending outward through said slot;

a handle pivotally mounted on said housing, said handle including an axle member integral with said handle and further including a lever arm extending radially outward from said axle member wherein said lever arm engages said shoulder;

a spring disposed about said axle member and acting to rotate said axle member such that said handle is urged inward towards said door surface; and a spring member disposed between said housing and said latch member operative to urge said latch member outward into a latch position.

13. A latch mechanism as set forth in claim 12 wherein said axle member includes opposite ends adapted to fit into apertures on said flange portions, each of said apertures including an upwardly sloped surface molded into the flange portions and the ends of the axial portion including a sloped surface thereon whereby the complementary sloped surfaces facilitate the assembly of the axle member to the housing to form a firm tight fitting engagement.

14. A latch mechanism as set forth in claim 13 wherein said latch mechanism consists of no more than three parts and a helical spring for biasing the latch into a locking position.

15. A latch mechanism as set forth in claim 14 wherein said housing and said handle are made of a glass filled plastic and said latch is made of a strong smooth low friction plastic.

* * * * *